US008532842B2

(12) United States Patent
Smith et al.

(10) Patent No.: US 8,532,842 B2
(45) Date of Patent: Sep. 10, 2013

(54) SYSTEM AND METHOD FOR REMOTELY CONTROLLING RAIL VEHICLES

(75) Inventors: Kristopher Smith, Melbourne, FL (US); Todd William Goodermuth, Melbourne, FL (US); Brian Schroeck, Melbourne, FL (US); Robert Bremmer, Melbourne, FL (US); Robert Foy, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 393 days.

(21) Appl. No.: 12/949,308

(22) Filed: Nov. 18, 2010

(65) Prior Publication Data

US 2012/0126065 A1 May 24, 2012

(51) Int. Cl.
*B61B 1/00* (2006.01)

(52) U.S. Cl.
USPC ..... 701/2; 701/19; 701/20; 701/36; 246/2 R; 246/4; 246/5; 246/6; 246/167 R; 246/186; 246/187 A

(58) Field of Classification Search
None
See application file for complete search history.

(56) References Cited

U.S. PATENT DOCUMENTS 4,023,753 A * 5/1977 Dobler ..... 246/5
4,994,969 A * 2/1991 Petit ..... 701/19
5,332,180 A * 7/1994 Peterson et al. ..... 246/3
5,340,062 A * 8/1994 Heggestad ..... 246/5
5,437,422 A * 8/1995 Newman ..... 246/5
5,564,657 A * 10/1996 Dimsa et al. ..... 246/187 A
5,685,507 A * 11/1997 Horst et al. ..... 246/187 A
5,751,569 A * 5/1998 Metel et al. ..... 700/3
6,135,396 A * 10/2000 Whitfield et al. ..... 246/182 R
6,246,956 B1 * 6/2001 Miyoshi et al. ..... 701/117
6,314,345 B1 * 11/2001 Coombes ..... 701/19
6,401,015 B1 * 6/2002 Stewart et al. ..... 701/19
6,449,536 B1 * 9/2002 Brousseau et al. ..... 701/19
6,480,810 B1 * 11/2002 Cardella et al. ..... 702/188
6,505,103 B1 * 1/2003 Howell et al. ..... 701/19
6,633,784 B1 * 10/2003 Lovelace et al. ..... 700/65
6,658,331 B2 * 12/2003 Horst et al. ..... 701/19
6,697,716 B2 * 2/2004 Horst ..... 701/19
6,789,004 B2 * 9/2004 Brousseau et al. ..... 701/19
6,799,097 B2 * 9/2004 Villarreal Antelo et al. ... 701/19
6,837,466 B2 * 1/2005 Peltz ..... 246/187 A
6,848,657 B2 * 2/2005 Young et al. ..... 246/1 R
6,854,691 B2 * 2/2005 Kraeling et al. ..... 246/2 F
6,856,865 B2 * 2/2005 Hawthorne ..... 701/19
6,937,925 B2 * 8/2005 Smith ..... 701/20
6,975,927 B2 * 12/2005 Szklar et al. ..... 701/19
6,996,461 B2 * 2/2006 Kane et al. ..... 701/19
7,038,597 B2 * 5/2006 Smith ..... 340/933
7,120,428 B2 * 10/2006 Higgs ..... 455/418
7,203,228 B2 * 4/2007 Horst et al. ..... 375/222

(Continued)

*Primary Examiner* — Jonathan M Dager
(74) *Attorney, Agent, or Firm* — GE Global Patent Operation; John A. Kramer

(57) ABSTRACT

Systems and methods for remotely controlling a rail vehicle are provided. In one embodiment, a remote operator control system includes a communication link to send and receive rail vehicle information, an operator interface, and a controller. The controller is configured to send, through the communication link, a request to establish communication with a positive train control system on-board a selected rail vehicle based on an operating condition. In response to receiving confirmation of communication with the positive train control system, the control is configured to receive positive train control information for the selected rail vehicle through the communication link, and display the positive train control information for the selected rail vehicle on the operator interface.

17 Claims, 7 Drawing Sheets

(56) References Cited

U.S. PATENT DOCUMENTS

| | | | | |
|---|---|---|---|---|
| 7,233,844 | B2 * | 6/2007 | Peltz et al. | 701/19 |
| 7,239,943 | B2 * | 7/2007 | Peltz | 701/19 |
| RE39,758 | E * | 8/2007 | Horst et al. | 246/187 A |
| 7,349,797 | B2 * | 3/2008 | Donnelly et al. | 701/115 |
| 7,520,472 | B2 * | 4/2009 | Peltz et al. | 246/187 A |
| 7,679,524 | B2 * | 3/2010 | Hofer et al. | 340/12.22 |
| 7,882,789 | B2 * | 2/2011 | Kumar et al. | 105/27 |
| 8,078,346 | B2 * | 12/2011 | Newton | 701/19 |
| 8,180,544 | B2 * | 5/2012 | Noffsinger et al. | 701/70 |
| 8,280,567 | B2 * | 10/2012 | Brand et al. | 701/19 |
| 8,280,569 | B2 * | 10/2012 | Kumar et al. | 701/20 |
| 8,290,646 | B2 * | 10/2012 | Ecton et al. | 701/19 |
| 8,295,993 | B2 * | 10/2012 | Kumar | 701/2 |
| 8,296,000 | B2 * | 10/2012 | Denny et al. | 701/19 |
| 2002/0062182 | A1 * | 5/2002 | Sato et al. | 701/19 |
| 2002/0084387 | A1 * | 7/2002 | Matheson et al. | 246/124 |
| 2002/0169530 | A1 * | 11/2002 | Laguer-Diaz et al. | 701/35 |
| 2003/0040853 | A1 * | 2/2003 | Brousseau et al. | 701/19 |
| 2003/0142796 | A1 * | 7/2003 | Ames, Jr. | 379/88.04 |
| 2003/0182029 | A1 * | 9/2003 | Horst et al. | 701/19 |
| 2003/0209638 | A1 * | 11/2003 | Peltz | 246/167 R |
| 2003/0222981 | A1 * | 12/2003 | Kisak et al. | 348/148 |
| 2004/0064223 | A1 * | 4/2004 | Horst et al. | 701/19 |
| 2004/0090315 | A1 * | 5/2004 | Mackjust et al. | 340/426.13 |
| 2004/0111722 | A1 * | 6/2004 | Horst et al. | 717/168 |
| 2004/0167687 | A1 * | 8/2004 | Kornick et al. | 701/19 |
| 2004/0238695 | A1 * | 12/2004 | Horst | 246/187 A |
| 2004/0245410 | A1 * | 12/2004 | Kisak et al. | 246/3 |
| 2005/0027410 | A1 * | 2/2005 | Kanner et al. | 701/19 |
| 2005/0125113 | A1 * | 6/2005 | Wheeler et al. | 701/19 |
| 2005/0228552 | A1 * | 10/2005 | Kornick et al. | 701/19 |
| 2006/0005738 | A1 * | 1/2006 | Kumar | 105/35 |
| 2008/0306641 | A1 | 12/2008 | Matusiak, Jr. et al. | |
| 2008/0312775 | A1 | 12/2008 | Kumar | |
| 2009/0184213 | A1 * | 7/2009 | Meyer | 246/3 |
| 2009/0248220 | A1 * | 10/2009 | Ecton et al. | 701/2 |
| 2009/0312890 | A1 * | 12/2009 | Evans | 701/2 |
| 2010/0145557 | A1 * | 6/2010 | Katzer | 701/20 |
| 2012/0078453 | A1 * | 3/2012 | Daum et al. | 701/19 |

* cited by examiner

SYSTEM AND METHOD FOR REMOTELY CONTROLLING RAIL VEHICLES

FIELD

The subject matter disclosed herein relates to remote control of a rail vehicle.

BACKGROUND

A rail vehicle, such as a locomotive that propels a group of rolling stock on a railroad track, is operated by a crew of multiple people. For example, a locomotive that is traveling on a main line railroad is typically operated by a crew of at least two people. In one example, a two-person crew includes an engineer and a conductor. The engineer drives the locomotive, for example by controlling speed and handling of the locomotive. On the other hand, the conductor manages operation of freight or passenger cars as well as various other types of railroad operations, such as track switching, and the like.

However, under some conditions, implementing a crew of two or more people to operate a locomotive is an inefficient use of labor resources. For example, during travel on the main line, the engineer performs a majority of the operational tasks while the conductor occasionally performs another railroad related task. In some cases, the engineer is prevented from performing tasks that are carried out by the conductor, because the engineer is required to have authority over the locomotive while on traveling on the main line by operating the controls, which are located in the locomotive cabin. Thus, the engineer is relegated to staying in the locomotive cabin while traveling on the main line, when they otherwise are capable of performing tasks carried out by the conductor.

BRIEF DESCRIPTION

Accordingly, to address the above issues, various embodiments of systems and methods for remotely controlling a rail vehicle are described herein. For example, in one embodiment, a remote operator control system comprises a communication link to send and receive rail vehicle information, an operator interface, and a controller. The controller is configured to send, through the communication link, a request to establish communication with a positive train control system on-board a selected rail vehicle based on an operating condition. The positive train control system is a system that monitors location and movement of the rail vehicle to enforce movement authorities and speed restrictions for a zone of track where the rail vehicle resides. In response to receiving confirmation of communication with the positive train control system, the control is configured to receive positive train control information for the selected rail vehicle through the communication link, and display the positive train control information for the selected rail vehicle on the operator interface.

In one example, the remote operator control system is a transportable apparatus that remains with a rail vehicle operator, such as an engineer of a locomotive. Since the remote operator control system receives positive train control information for the locomotive, the operator is able to stay informed of the positive train control information even when the engineer leaves the cabin of the locomotive. In other words, the engineer maintains authority of the locomotive even when the engineer leaves the cabin of the locomotive. Accordingly, the engineer is able to perform other rail road related tasks, such as tasks carried out by a conductor, while staying in compliance by maintaining authority of the locomotive. In this way, locomotive crews can be reduced and labor can be re-allocated, which results in cost reductions.

This brief description is provided to introduce a selection of concepts in a simplified form that are further described below in the detailed description. This brief description is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

The present invention will be better understood from reading the following description of non-limiting embodiments, with reference to the attached drawings, wherein below.

DETAILED DESCRIPTION

Figure 1:
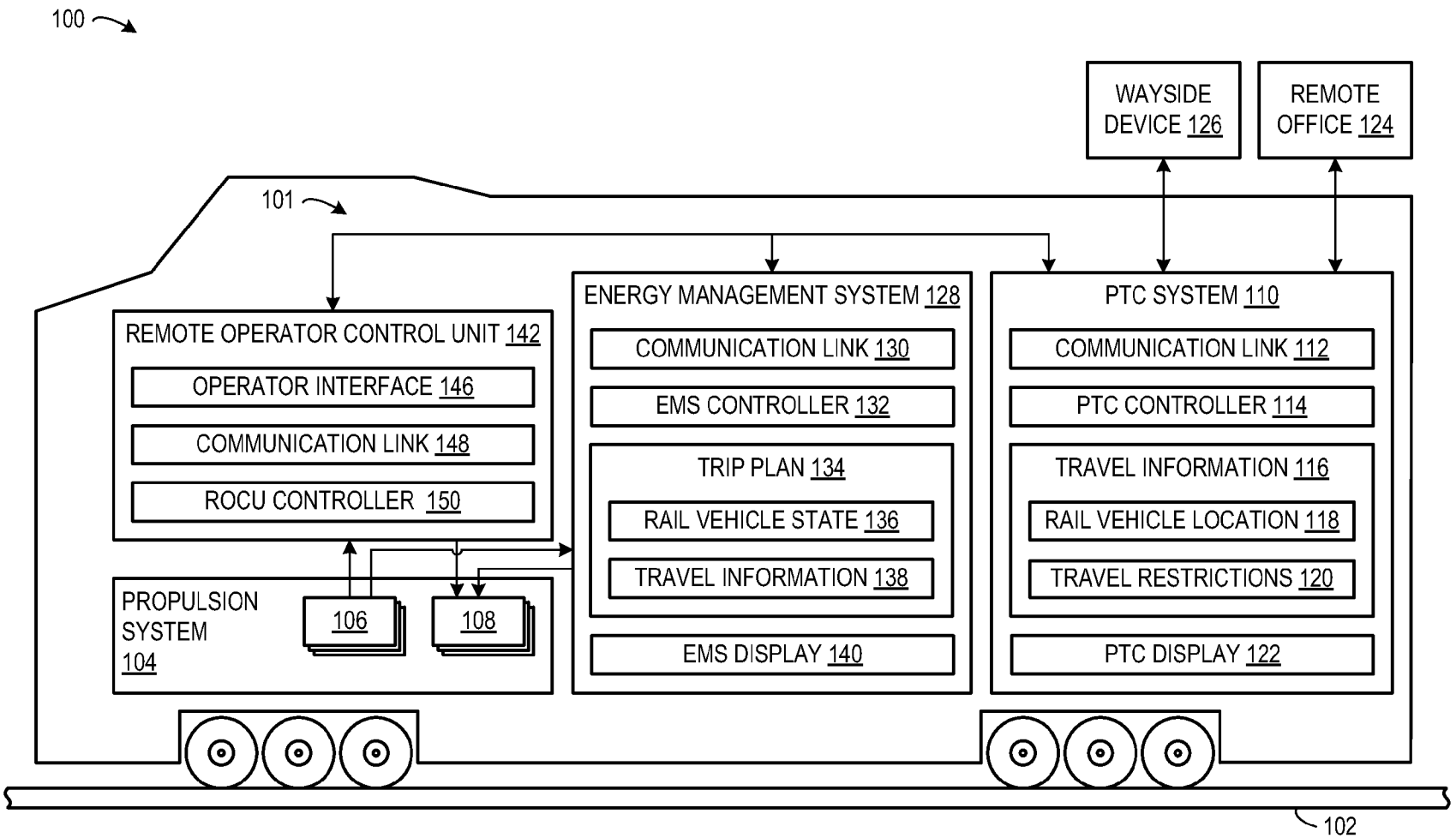
FIG. 1 is a schematic diagram of an example embodiment of a rail vehicle of the present disclosure.

The present disclosure is directed to a remote control system that has communication paths that are integrated with other systems located on-board a rail vehicle so that the remote control system can receive information about the rail vehicle as well as provide control commands to operate the rail vehicle. In one example, as illustrated in FIG. 1, a remote operator control unit (ROCU) communicates with a positive train control (PTC) system that is located on-board a rail vehicle. The ROCU receives PTC information about the location of the rail vehicle and the travel path associated with the rail vehicle. The PTC information is displayed by an operator interface on the ROCU so that an operator of the rail vehicle can remain informed of the state of the rail vehicle location even when the operator is remotely located from the on-board PTC system.

As another example, the ROCU communicates with an energy management system (EMS) that is located on-board the rail vehicle. When in control of operation of the rail vehicle, the EMS provides control commands to the rail vehicle based on an operating state of the rail vehicle to increase or optimize efficiency of the rail vehicle (e.g., reduce fuel consumption) for a predefined trip. The communication path between the ROCU and the EMS enables an operator to switch control of the rail vehicle between the ROCU and the EMS as desired. For example, the operator can control operation of the rail vehicle manually through input to the operator interface of the ROCU. On the other hand, the operator can switch to the EMS for automated control of rail vehicle operation. In this manner, an operator is able to receive rail vehicle information and adjust control of rail vehicle operation to accommodate varying travel conditions even when the operator is remotely located from systems that are positioned on-board the rail vehicle.

FIG. 1 is a schematic diagram of an example embodiment of a vehicle or vehicle system, herein depicted as a rail vehicle 100, configured to travel on a rail 102. The rail vehicle 100 includes a propulsion system 104. In one example, the propulsion system 104 includes an engine, such as diesel engine that combusts air and diesel fuel through compression ignition. In other non-limiting embodiments, the propulsion system 104 includes an engine that combusts fuel including gasoline, kerosene, biodiesel, or other petroleum distillates of similar density through compression ignition (or spark ignition). In one example, the rail vehicle 100 is a diesel-electric vehicle. For example, the propulsion system 104 is a diesel engine that generates a torque output that is converted to electricity by an alternator (not shown) for subsequent propagation to a variety of downstream electrical components. The alternator provides electrical power to a plurality of traction motors (not shown) to provide tractive power to propel the rail vehicle 100. Correspondingly, the tractive motors provide regenerative braking capabilities to slow the rail vehicle during braking conditions. Moreover, the propulsion system 104 includes brakes (not shown), such as air brakes or friction brakes that are operable to slow the rail vehicle 100.

The propulsion system 104 includes sensors 106 that measure operating parameters of the rail vehicle 100. In one example, the sensors 106 measure engine operating parameters including, but not limited to, barometric air pressure, mass air pressure, ambient temperature, engine coolant temperature, engine speed, engine torque, air/fuel ratio, exhaust pressure, exhaust temperature, etc. In one example, the sensors 106 measure electrical operating parameters including, but not limited to, electrical output, horsepower, battery state of charge, traction motor speed, traction motor temperature, etc. In one example, the sensors 106 measure rail vehicle position parameters including, but not limited to, beginning of rail vehicle location, end of rail vehicle location, etc. It will be appreciated that the sensors 106 measures a suitable operating parameter or may be used to determine a suitable operating parameter or operating condition of the rail vehicle 100.

The propulsion system 104 includes actuators 108, the state of which is varied to adjust operation of the propulsion system 104. In one example, actuators 108 adjust engine operation. Example actuators that are adjusted to control engine operation include cylinder valves, fuel injectors, throttle, etc. In one example, actuators 108 adjust electrical components. Example electrical components that are adjusted to control operation of the rail vehicle include the alternator, traction motors, etc. It will be appreciated that the actuators 108 include a suitable component for adjusting operation of the rail vehicle 100.

A positive train control (PTC) system 110 is positioned in a cabin 101 of the rail vehicle system 100 to monitor the location and movement of the rail vehicle 100. The PTC system 110 includes a communication link 112, a PTC controller 114, travel information 116, and a PTC display 122.

The communication link 112 communicates with a dispatch at a remote office 124, wayside devices 126, and a remote operator control unit 142 to send and receive travel information 116. In particular, the PTC system 110 sends rail vehicle state and location information 118 to the remote office 124. Correspondingly, the PTC system 110 receives location, track, and travel restriction information 120 from the remote office 124. In one example, the communication link 112 includes a radio transceiver. The radio transceiver operates at a 220 MHz radio frequency that allows for a range of approximately 20-30 miles. In one example, the communication link includes a global positioning system (GPS) device to determine a location of the rail vehicle 100 that is sent to the remote office 124 and/or the wayside device 126. In one example, the PTC system 110 is capable of operating in either dark (non-signaled) or signaled territory by employing GPS navigation to track the location of the rail vehicle 100.

In some cases, the remote office 124 relays information through a base station or the wayside device 126 to the communication link 112. The base stations and/or wayside devices are positioned at intervals within the broadcast range of the communication link 112 to stay in communication during travel. In one example, a base station is approximately a 100-foot tall tower that includes antennas and radios with multi-channel receivers that send and receive radio signal up and down the length of the rail road track. If there are several tracks in an area, the base station and/or wayside device 126 can include a bank of radio channels that different rail vehicles can log onto and communicate with during traveling throughout a zone. In some cases, the wayside devices 126 have an antennae with a much shorter length of frequency range and can either communicate directly to the communication link 112 or through the base station and then to the rail vehicle 100. In some cases, the communication link 112 receives speed restrictions generated from the remote office 124 and then communicate in signal territory to the wayside device 126 to coordinate movement of the rail vehicle 100.

The PTC controller 114 manages operation of the PTC system 110. In one example, the PTC controller 114 includes a computer system including a processor and a non-transitive storage device that holds instructions that when executed perform operations to control the PTC system 110. For example, the PTC controller 114 enforces travel restrictions including movement authorities that prevent unwarranted movement of the rail vehicle 100. In some embodiments, the PTC system 110 controls operation of the rail vehicle to comply with the movement authorities. Based on the received travel information 116, the PTC controller 114 determines the location of the locomotive and how fast it can travel based on the travel restrictions, and determines if movement enforcement is performed to adjust the speed of the rail vehicle 100. In this way, rail vehicle collisions, over speed derailments, incursions into work zones, and/or travel through an improperly positioned switch can be reduced or prevented. As an example, the PTC system 110 provides commands to the propulsion system 104 to slow or stop the rail vehicle 100 in order to comply with a movement authority.

The travel information 116 is organized into a database that is stored in a storage device of the PTC controller 114. In one example, the database houses rail road track information that is updated by the remote office 124 through the communication link 112. The travel information 116 includes rail vehicle location information 118. In one example, the rail vehicle location information 118 is determined from GPS information of the communication link 112. In one example the rail vehicle location information 118 is determined from sensors 106 such as beginning of rail vehicle location and end of rail vehicle location sensors. In one example, rail vehicle location information 118 is determined through communication with the wayside devices 126. The travel information 116 includes travel restriction information 120. The travel restriction information 120 includes movement authorities and speed limits which can be travel zone or track dependent. The travel restriction information 120 can take into account rail vehicle state information such as length, weight, height, etc.

The PTC display 122 is positioned in the cabin 101 of the rail vehicle 100 to display travel information 116 as well as other rail vehicle state and control information to the operator. The PTC display 122 is dedicated to displaying PTC information separate or independent of the remote operator control unit 142 including an operator interface 146.

An energy management system (EMS) 128 is positioned in the cabin 101 of the rail vehicle system 100 to controlling speed of the rail vehicle 100 to increase operating efficiency by reducing fuel usage. The EMS 128 includes a communication link 130, an EMS controller 132, trip plan information 134, and an EMS display 140.

The communication link 130 communicates with the PTC system 110 and the remote operator control unit 142 to send and receive rail vehicle state and location information, travel information, and other suitable information. In one example the communication link 130 receives rail vehicle manifests, temporary slow orders, and/or rail road track database updates. Furthermore, the communication link 130 receives signals from the sensors 106 and sends command signals to the actuators 108 to adjust operation of the propulsion system 104. In one example, the communication link 130 includes a radio transceiver that enables wireless communication. In particular, the communication link sends and/or receives multiple messages per second to enable communication.

The EMS controller 132 manages operation of the EMS system 128. In one example, the EMS controller 132 includes a computer system including a processor and a non-transitive storage device that holds instructions that when executed perform operations to control the EMS system 128. For example, the EMS controller 132 evaluates predefined travel paths or routes for fuel savings opportunities and plots rail vehicle speed based on operating conditions. Furthermore, the EMS controller 132 provides automated closed loop control of the actuators 108 of the propulsion system 104. In one example the closed loop control is based on a location determination, speed regulation, and/or rail vehicle state. The closed loop control reduces unnecessary braking and automatically operates the throttle based on feedback from speed and acceleration data received from the sensors 106.

The trip plan information 134 is organized into a database that is stored in a storage device of the EMS controller 132. In one example, the database houses a fuel usage profile, rail vehicle estimator/corrections, and/or rail vehicle handling algorithms. The trip plan information 134 provides a plan of operation for the rail vehicle to increase efficiency that is based on rail vehicle state information 136 and travel information 138. In one example, the rail vehicle state information 136 includes rail vehicle velocity and rail vehicle characteristics that are used for adjusting speed and time recovery. It will be appreciated that rail vehicle state information 136 includes suitable information determined from signals received from the sensors 106, other controllers, and/or GPS information. In one example, the travel information 138 includes trip time, rail vehicle location, and rail road track information, such as anticipated grades, movement authorities, and speed restrictions. In some embodiments, the EMS 128 receives travel information from the PTC system 110.

The EMS display 140 is positioned in the cabin 101 of the rail vehicle 100 to display the trip plan information 134 as well as other rail vehicle state and control information to the operator. In one example, the EMS display 140 presents rail vehicle status information and a rolling map that includes rail road track zones and the like. The EMS display 140 is dedicated to displaying EMS information separate or independent of the remote operator control unit 142 including the operator interface 146. The EMS display 140 is repeatedly updated to provide the operator with a tool to manage the rail vehicle trip by showing trades between trip time and fuel used, as opposed to operating at or near the speed limit all the time.

The remote operator control unit (ROCU) or system 142 provides an operator of the rail vehicle 100 with information received from the PTC system 110 and the EMS 128. Furthermore, the ROCU 142 provides the operator with manual control capability to control operation of the rail vehicle 100 from a location that is remote from the cabin 101 of the rail vehicle 100. The ROCU 142 enables the operator to remotely switch between manual operation of the rail vehicle and automated operation of the rail vehicle through control by the EMS 128. In one example, the ROCU 142 is a transportable apparatus that enables the operator to maintain control authority over a rail vehicle, even when the operator is remotely located from the cabin of the rail vehicle. The ROCU 142 includes a communication link 148, an operator interface 146, and a ROCU controller 150.

The communication link 148 provides integrated communication paths to communicate with the PTC system 110 and the EMS 128. Through the integrated communication paths, the communication link 148 is able to send and/receive rail vehicle state 136 and location 118 information from the PTC system 110 and/or the EMS 128. Furthermore, the communication link 148 communicates with the sensors 106 to receive rail vehicle state information and with the actuators 108 to send control commands to adjust operation of the rail vehicle 100. In one example, the communication link 148 includes a radio transceiver to enable wireless communication.

The operator interface 146 includes a display 202 (shown in FIG. 2) to display information received from the PTC system 110 and the EMS 128 as well as an operator input 206 (shown in FIG. 2) that enables the operator to input control commands to manually control operation of the rail vehicle 100 as well as switch to and from automated control by the EMS 128.

The ROCU controller 150 manages operation of the ROCU 142. In one example, the ROCU controller 150 includes a computer system including a processor and a non-transitive storage device that holds instructions that when executed perform operations to control the ROCU 142. For example, the ROCU controller 150 provides control command manually input by the operator to adjust the actuators 108 of the propulsion system 104. Furthermore the ROCU controller 150 provides control commands to the EMS 128 to transfer control to the ROCU 142 for manual control of operation of the rail vehicle 100 or transfer control to the EMS 128 for automated control of operation of the rail vehicle 100. In some cases, control of operation of the rail vehicle is automatically transferred between the ROCU 142 and the EMS 128 based on operating conditions of the rail vehicle 100.

Figure 2:
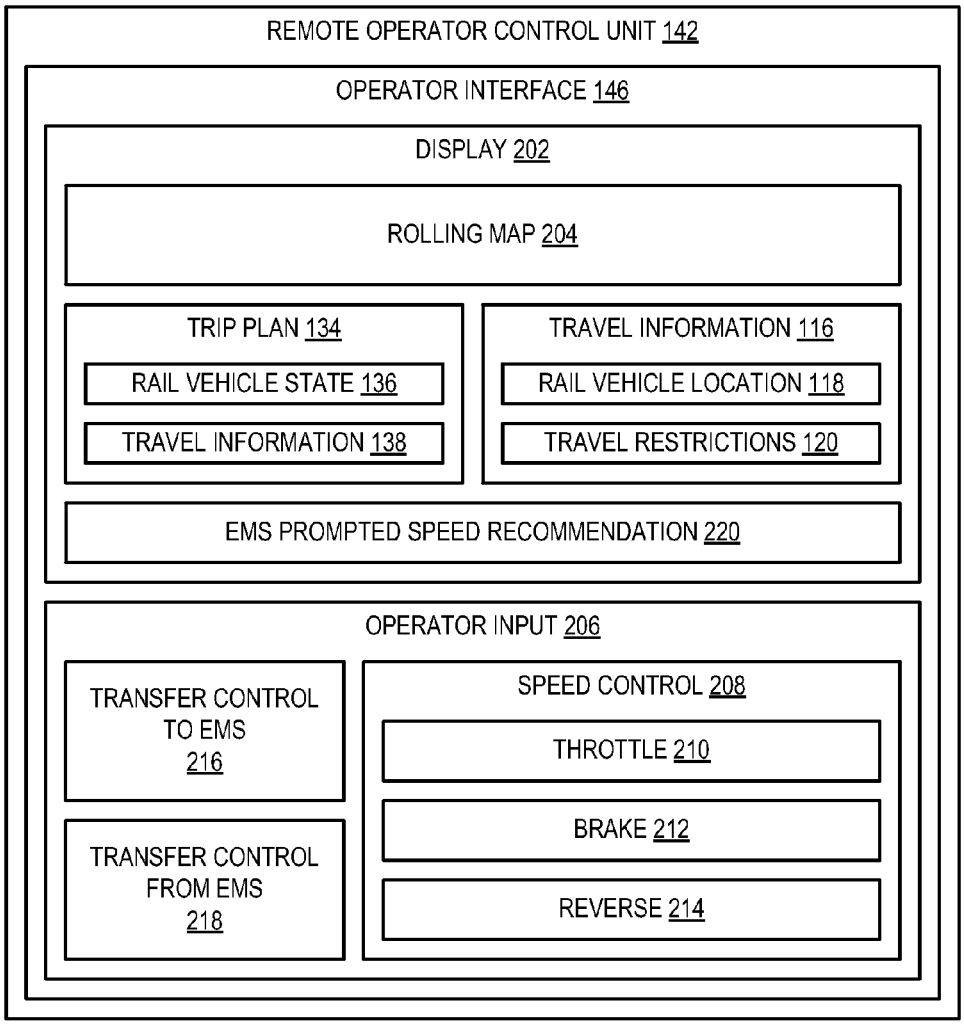
FIG. 2 is a block diagram of an example embodiment of an operator interface of a remote control operator unit (ROCU) of the present disclosure.

FIG. 2 is a block diagram of an example embodiment of the operator interface 146 of the ROCU 142. As discussed above, the operator interface 146 includes a display 202 that presents rail vehicle system information to the operator as well an operator input 206 to provide control command input to manually control operation the rail vehicle 100. Furthermore, the operator input 206 enables the operator to input control commands to switch between manual control of operation of the rail vehicle 100 and automated control of operation of the rail vehicle 100 by the EMS 128.

The display 202 presents a rolling map 204 as well as system information received from other system of the rail vehicle 100. The rolling map 204 provides an indication of the location of the rail vehicle 100 to the operator. The rolling map 204 is annotated with various rail vehicle location information. For example the rolling map 204 includes a beginning of rail vehicle location, an end of rail vehicle location, rail vehicle length, rail road track zone, mile post markers, wayside device location, GPS location, etc. Furthermore, the rolling map 204 is annotated with movement authority regulations and speed restrictions.

Furthermore, the display 202 presents information received from the PTC system 110. In particular, the display 202 presents travel information 116 that includes rail vehicle location information 118 and travel restriction information 120. The display 202 presents information received from the EMS 128. In particular, the display 202 presents trip planner information 134 that includes rail vehicle state information 136 and travel information 138. It will be appreciated that the display 202 presents a suitable information related to the state and/or location of the rail vehicle 100 that is receive from other systems of the rail vehicle 100. In some cases, the display 202 presents information that is received directly from the wayside device 126 and/or the remote office 124.

The operator input 206 enables the operator to provide control commands to control operation of the rail vehicle 100. In one example, the operator input 206 includes buttons, switches, and the like that are physically actuated to provide input. In one example, the operator input 206 includes a touch sensitive display that senses touch input by the operator. The operator input 206 includes a speed control 208. The speed control 208 initiate the sending of control commands to actuators 108 responsive to operator input that manually adjusts the speed of the rail vehicle 100. In particular, the speed control 208 includes a throttle input 210, a brake input 212, and a reverse input 214. The speed control 206 may provides speed adjustment in a suitable manner.

Furthermore, the operator input 206 includes a transfer control to EMS input 216 and a transfer control input from EMS input 218. The transfer control to EMS input 216 initiates sending of control commands to the EMS 128 responsive to operator input to take control of operation of the rail vehicle 100 for automated control. The transfer control from the EMS input 218 initiates sending of control commands to the EMS 128 responsive to operator input to relinquish control of operation of the rail vehicle 100 to the ROCU 142 for manual control.

In some embodiments, the EMS 128 is a passive system that prompts the operator with suggested operating parameters to reducing fuel consumption and decrease braking In such embodiments, the display 202 presents an EMS prompted speed recommendation 220 that is updated based on operating conditions of the rail vehicle 100.

Figure 3:
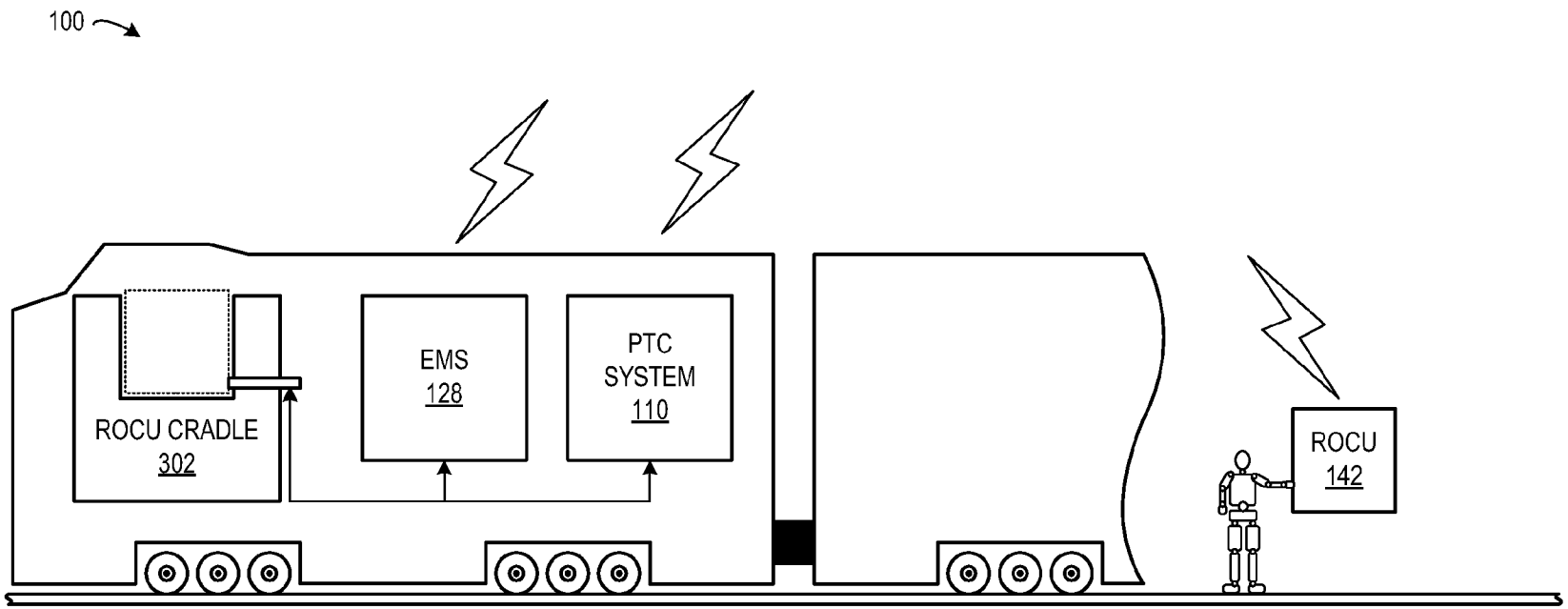
FIG. 3 is a schematic diagram illustrating an example of a ROCU communicating with control systems of a rail vehicle to remotely control the rail vehicle.

FIG. 3 is a schematic diagram illustrating an example of a ROCU communicating with control systems (e.g., the PTC system 110 and the EMS 128) to remotely control the rail vehicle 100. In some embodiments, the ROCU 142 temporarily resides in a ROCU cradle 302 that is positioned inside of the cabin 101 of the rail vehicle 100. The ROCU cradle 302 provides various capabilities to the ROCU 142. For example, the ROCU cradle 302 provides power charging capabilities to the ROCU 142. The ROCU 142 is removable from the ROCU cradle 302 so that the operator can take the ROCU 142 from the cabin 101 of the rail vehicle 100 to perform various tasks and still receive rail vehicle state and location information as well as have authority over the rail vehicle 100.

In some embodiments, the ROCU 142 is configured to automatically synchronize with other systems of the rail vehicle 100 in response to the ROCU 142 being removed from the ROCU cradle 302. In one example, when the ROCU 142 is removed from the ROCU cradle 302, communication is initiated between the ROCU 142 and the PTC system 110 as well as the EMS 128. Correspondingly, the PTC system 110 and the EMS 128 send information to the ROCU 142 to be presented to the operator. In this manner, the operator may stay informed of rail vehicle state and location information, even when the operator leaves the cabin 101 of the rail vehicle 100.

Additionally (or alternatively) the ROCU 142 proximal communication capabilities to selectively initiate synchronization with other systems of the rail vehicle 100. In one example, the ROCU 142 includes an infrared (IR) port that can be used to initiate synchronization. In one example, the ROCU 142 includes a radio frequency identification (RFID) device that is used to detect proximity to the cabin 101 of the rail vehicle 100, such that when the ROCU 142 leaves the cabin the RFID device detects the change in location and synchronization is initiated. It will be appreciated that various other technologies may be implemented to implement synchronization between the ROCU 142 and other systems of the rail vehicle 100.

Furthermore, control commands can be sent from the ROCU 142 to the EMS 128 responsive to removal of the ROCU 142 from the ROCU cradle 302. The control commands are sent through the established communication path to switch between manual control through the ROCU 142 and automated control through the EMS 128. Further still, in one example, when the ROCU 142 is removed from the ROCU cradle 302, communication is initiated between the ROCU 142 and the sensor 106 as well as the actuators 108. In this manner, the operator may provide automated or manual control of the rail vehicle 100, even when the operator leaves the cabin 101 of the rail vehicle 100.

The ROCU 142 is configured to transfer control of operation of the rail vehicle 100 between the ROCU 142 and the EMS 128 based on different operating conditions. FIGS. 4-11 depict different examples of operating conditions that elicit transfer of control between the ROCU 142 and the EMS 128. FIGS. 4-7 depict examples where control is automatically switched between the ROCU 142 and the EMS 128. FIGS. 8-11 depict examples where control is manually switched between the ROCU 142 and the EMS 128 in response to operator input to the ROCU 142.

Figure 5:
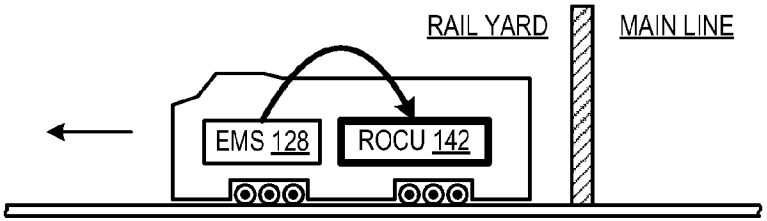
FIG. 5 is a schematic diagram depicting control of the rail vehicle of FIG. 4 automatically switching from the EMS to a ROCU responsive to the rail vehicle switching from the main line to a rail yard.
Figure 4:
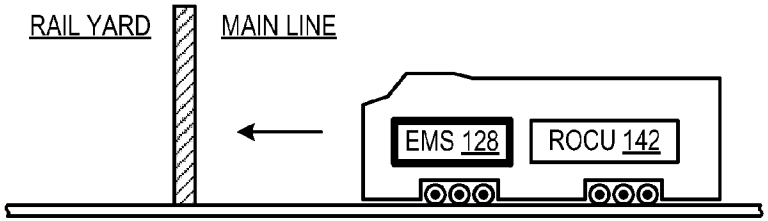
FIG. 4 is a schematic diagram depicting an example of a rail vehicle being controlled by an energy management system (EMS) on a main line.

FIGS. 4 and 5 depict a first example where control of the rail vehicle is automatically switched based on an operating condition. In this example, the operating condition includes the rail vehicle crossing over from a rail road main line to a rail yard. FIG. 4 depicts a rail vehicle that is being controlled by the EMS 128 while traveling on the main line. The EMS 128 provides rail vehicle control commands that increase efficiency of the rail vehicle by finding opportunities to adjust operation to reduce unwarranted braking and reduce fuel consumption. FIG. 5 depicts the rail vehicle of FIG. 4 crossing from the main line into a rail yard. Once in the rail yard, more flexible manual operation of the rail vehicle is prioritized over trip efficiency, since the rail vehicle can be stationary and start/stopped periodically. Accordingly, control of the rail vehicle is automatically transferred from the EMS 128 to the ROCU 142 in response to the rail vehicle crossing from the main line into the rail yard. Since operation of the rail vehicle is manual controlled by the operator through the ROCU 142, the operator can position the rail vehicle as desired even when leaving the cabin of the rail vehicle. For example, the operator can manually control the rail vehicle when the operator is remotely located from the rail vehicle, such as when the operator is disconnecting a knuckle of a rail car on a different track in the rail yard to reconfigure the rolling stock.

Figure 7:
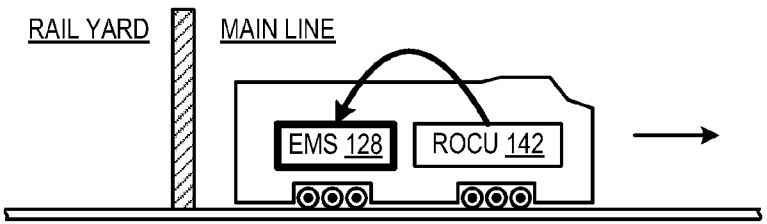
FIG. 7 is a schematic diagram depicting control of the rail vehicle of FIG. 6 automatically switching from the ROCU to an EMS responsive to the rail vehicle switching from the rail yard to a main line.
Figure 6:
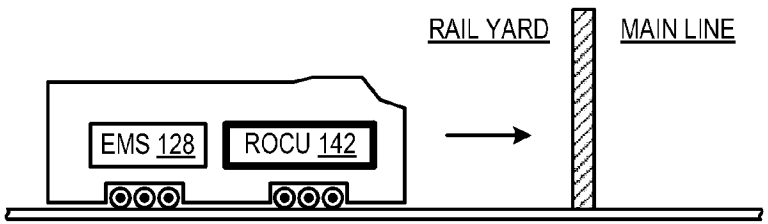
FIG. 6 is a schematic diagram depicting an example of a rail vehicle being controlled by a ROCU in a rail yard.

FIGS. 6 and 7 depict another example where control of the rail vehicle is automatically switched based on an operating condition. In this example, the operating condition includes the rail vehicle crossing over from a rail yard onto a rail road main line. FIG. 6 depicts a rail vehicle that is being controlled by the ROCU 142 in the rail yard. The ROCU 142 allows for more flexible manual control by the operator in order to configure the rail vehicle for storage or travel. FIG. 7 depicts the rail vehicle of FIG. 6 crossing from the rail yard to the main line. Once on the main line, increased speed and efficiency provided by automatic operation are prioritized over more flexible manual operation. Accordingly, control of the rail vehicle is automatically transferred from the ROCU 142 to the EMS 128 in response to the rail vehicle crossing from the rail yard to the main line. It will be appreciated that transfer of control of operation of the rail vehicle may be performed automatically in response to various other suitable operating conditions. Moreover, the ROCU 142 maintains supervisory control when the rail vehicle is being controlled by the EMS 128. For example, the operator can manually command an adjustment in operation (e.g., a stop) when the EMS is in control of rail vehicle operation, and the EMS relinquishes control to comply with the manual command provided by the ROCU 142.

Although the above examples describe scenarios where control of rail vehicle operation is switched automatically based on operating conditions, it will be appreciated that in some embodiments, an operator initiates the transfer of control between manually controlled operation and EMS controlled operation. In this way, the operator has authority over the rail vehicle including the EMS system through the ROCU. To further support such authority, in one example, transferring control includes confirmations or handshakes between systems (e.g., ROCU and EMS) to reduce the likelihood of unintended transfer of control of the rail vehicle.

Figure 8:
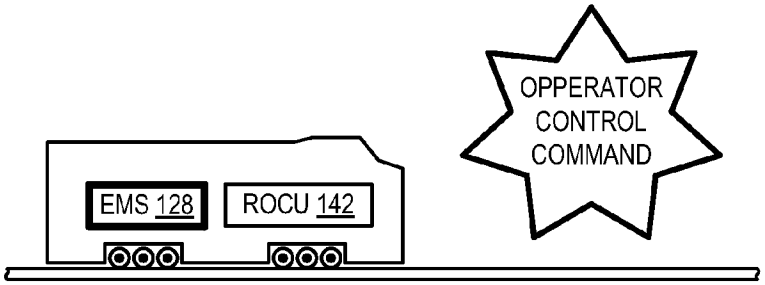
FIG. 8 is a schematic diagram depicting an example of a rail vehicle being controlled by an EMS.
Figure 9:
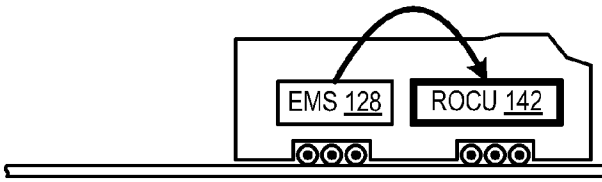
FIG. 9 is a schematic diagram depicting control of the rail vehicle of FIG. 8 being switched from the EMS to a ROCU responsive to an operator control command.

FIGS. 8 and 9 depict a first example where control of the rail vehicle is manually switched based on operator input to the ROCU 142. FIG. 8 depicts an example of a rail vehicle being controlled by the EMS 128. For example, the rail vehicle is traveling on a main line. For a suitable reason, the operator decides to switch from automatic to manual control. For example, the operator wants to stop the rail vehicle in order to switch a track. The operator provides an operator control command, such as depressing the transfer control from EMS input 218 on the ROCU 142. As shown in FIG. 9, control of the rail vehicle is transferred from the EMS 128 to the ROCU 142 in response to the operator control command.

Figure 10:
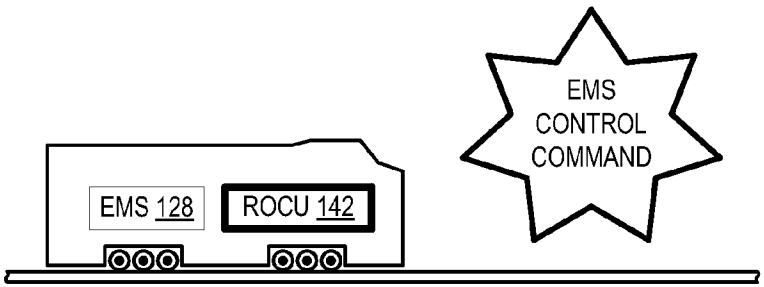
FIG. 10 is a schematic diagram depicting an example of a rail vehicle being controlled by a ROCU.
Figure 11:
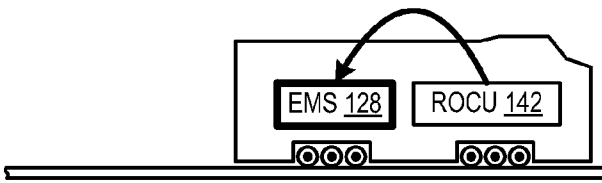
FIG. 11 is a schematic diagram depicting control of the rail vehicle of FIG. 10 switching from the ROCU to an EMS response to an operator control command.

FIGS. 10 and 11 depict another example where control of the rail vehicle is manually switched based on operator input to the ROCU 142. FIG. 10 depicts an example of a rail vehicle being controlled by the ROCU 142. For example, the rail vehicle may be stopped on the main line while the operator is switching the track. Upon switching the track, the operator is ready to resume the run down the line. To operate the trip more efficiently, the operator provides an operator control command, such as depressing the transfer control to EMS input 216 on the ROCU 142. As shown in FIG. 11, control of the rail vehicle is transferred from the ROCU 142 to the EMS 128 in response to the operator control command. As demonstrated in the above described examples, the ROCU 142 enables switching between manual and automatic control of the rail vehicle even when the operator is positioned remotely from the EMS 128.

Figure 12:
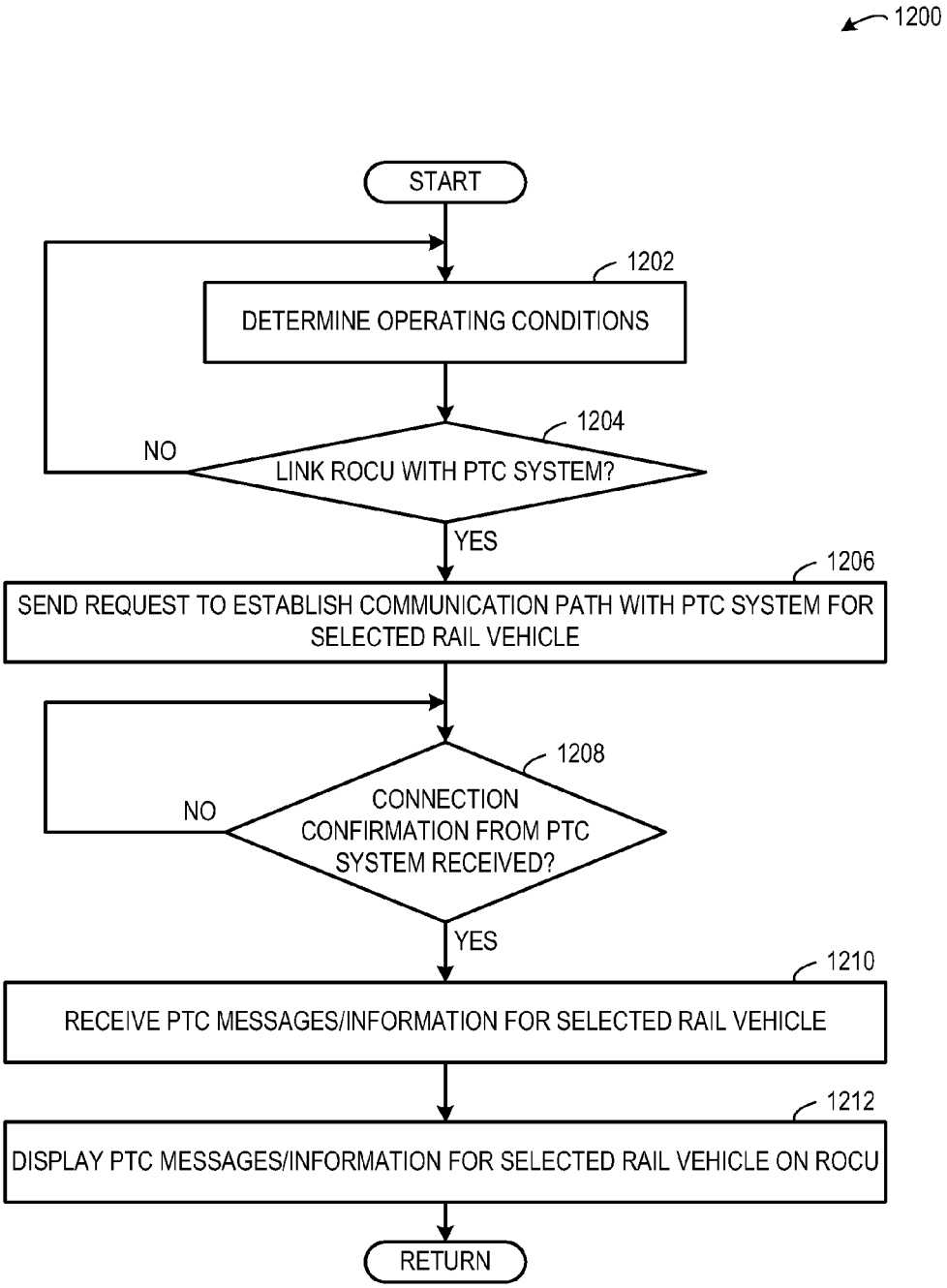
FIG. 12 is a flow diagram of an example embodiment of a method for of establishing a communications path between a ROCU and an on-board positive train control (PTC) system so that PTC information is received by the ROCU.

FIG. 12 is a flow diagram of an example embodiment of a method 1200 for of establishing a communications path between a ROCU and an on-board positive train control (PTC) system so that PTC information is received by the ROCU. In one example, the method 1200 is performed by the ROCU 142 to communicate with the PTC system 110. At 1202, the method includes determining operating conditions. Determining operating conditions includes determining an operating state of the ROCU 142. For example, it can be determined whether or not the ROCU has established a communication path with other systems of a rail vehicle. In embodiments where the ROCU communicates with other systems based on whether or not the ROCU is positioned in a cradle, it can be determined whether or not the ROCU is positioned in a cradle.

At 1204, the method includes determining if operating conditions are suitable for a communication link to be established between the ROCU 142 and the PTC system 110. If operating conditions are suitable to establish a communication path between the ROCU and the PTC system, the method moves to 1206. Otherwise, the method returns to 1202.

At 1206, the method includes sending a request to establish a communication path with a PTC system for a selected rail vehicle. In some cases, a plurality of different rail vehicle may be in communication range of the ROCU, such as in a rail yard. Accordingly, the request includes a rail vehicle identifier that indicates the selected rail vehicle.

At 1208, the method includes determining if a connection confirmation has been received from the PTC system of the selected rail vehicle. If it is determined that the PTC has confirmed connection with the ROCU, the method moves to 1210. Otherwise, the method returns to 1208.

At 1210, the method includes receiving PTC messages or information from the PTC system for the selected rail vehicle. As discussed above, the PTC information includes rail vehicle state and location information. Furthermore, the PTC information includes track condition, movement authority, and speed restriction information. In some cases the PTC information may be information that is sent from a remote office that is relayed through the PTC system.

At 1212, the method includes displaying the received PTC messages or information on a display of the ROCU. In one example, PTC information is presented on display 202 of ROCU 142.

By establishing a communication path between a ROCU and a PTC system of a selected rail vehicle, an operator may view PTC information for the selected rail vehicle on a display of the ROCU, even when the operator is located remotely from a cabin of the rail vehicle where the PTC system is located. Moreover, since the operator is able to have the PTC information on their person, the operator is able to maintain authority of the rail vehicle even when the operator leaves the cabin. Accordingly, the operator is able to perform tasks that they would otherwise not be able to perform, such as tasks performed by a conductor. In this way, an operator is able to perform more tasked while being informed of PTC information for a rail vehicle. This enables a single-person crew to operate a rail vehicle on the main line with PTC technology implemented. Moreover, this may allow for a reduction or re-allocation of labor to other tasks, rail vehicles, etc. that results in cost savings.

Furthermore, since the ROCU is a portable apparatus, the ROCU can establish communication paths with different PTC systems for different rail vehicles. This can be beneficial in situations where a plurality of rail vehicles is located in a proximity to one another, such as in a rail yard. In this way, an operator may be informed of PTC information for different rail vehicles and perform tasks related to the different rail vehicles without having to enter the cabin of each of the rail vehicles.

Note the above method is applicable to establishing communication paths between the ROCU and other systems of a rail vehicle. For example, the above method may be performed to establish communication between the ROCU and an EMS of a rail vehicle.

Figure 13:
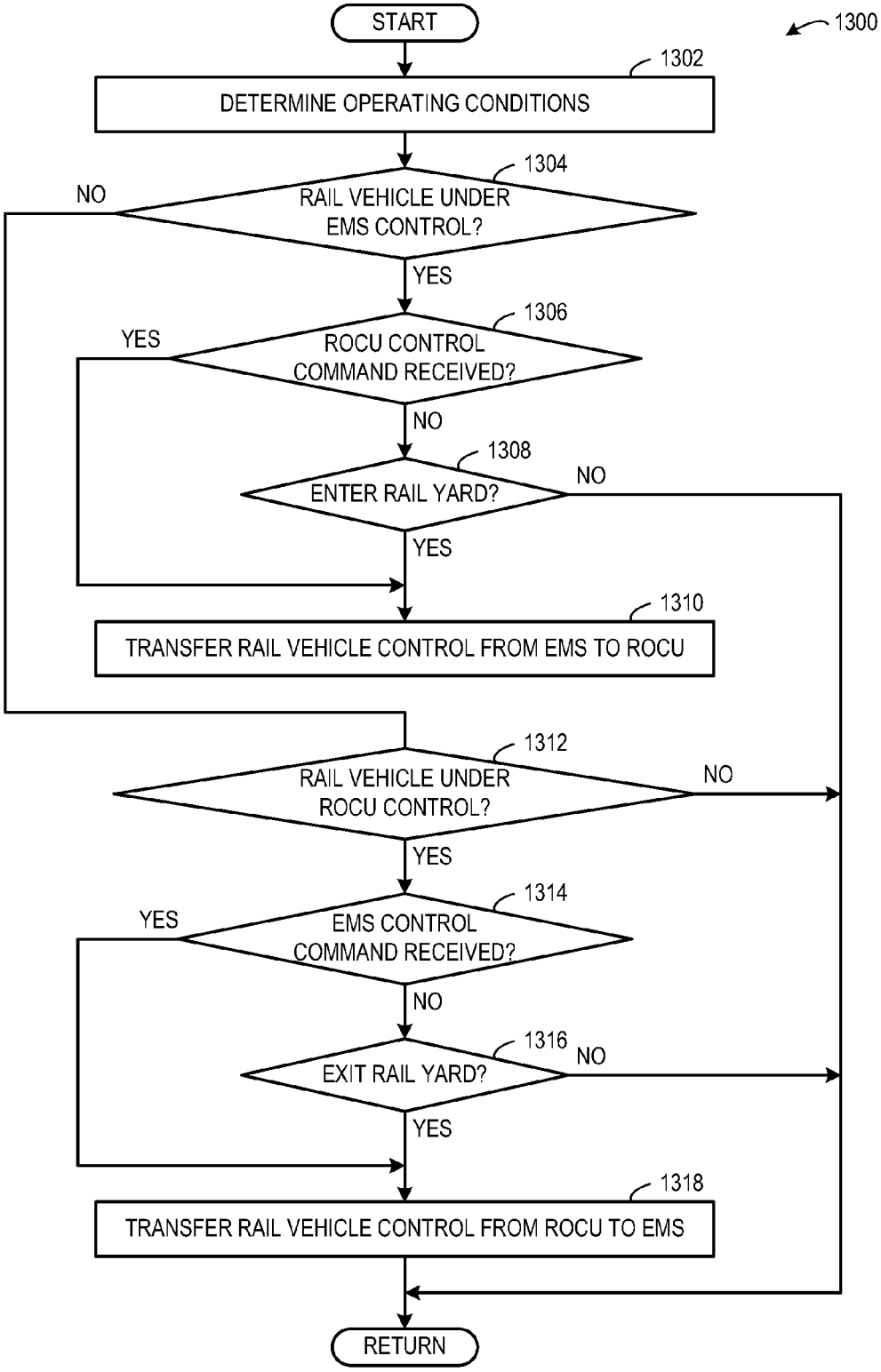
FIG. 13 is a flow diagram of an example embodiment of a method for switching control of a rail vehicle between an on-board EMS and a ROCU based on operating conditions.

FIG. 13 is a flow diagram of an example embodiment of a method 1300 for switching control of a rail vehicle between an on-board EMS of the rail vehicle and a ROCU based on operating conditions. In one example, the method is performed by the ROCU 142, which sends control commands to EMS 128.

At 1302, the method includes determining operating conditions. Determining operating conditions includes determining rail vehicle state and location based on information received from other systems of the rail vehicle that are in communication with the ROCU. Determining operating conditions includes determining which system is controlling the rail vehicle. For example, the rail vehicle may be manually controlled by an operator in the cabin using rail vehicle controls. As another example, the rail vehicle may be automatically controlled by the on-board EMS. As yet another example, the rail vehicle may be manually controlled by an operator that is located remotely from the cabin of the rail vehicle through the ROCU.

At 1304, the method includes determining if the rail vehicle is under automatic EMS control. If the EMS is controlling operation of the rail vehicle, the method moves to 1306. Otherwise, the method moves to 1312.

At 1306, the method includes determining if an operator control command has been received by the ROCU commanding control of the rail vehicle be transferred from the EMS to the ROCU. If it is determined that the operator control command has been received, the method moves to 1310. Otherwise, the method moves to 1308.

At 1308, the method includes determining if the rail vehicle has entered a rail yard. If it is determined that the rail vehicle has entered the rail yard, the method moves to 1310. Otherwise, the method returns to other operations.

At 1310, the method includes transferring control of the rail vehicle from the EMS to the ROCU. In one example, the ROCU sends a command to the EMS to relinquish control of the rail vehicle to the ROCU. Control of the rail vehicle is transferred from the EMS to the ROCU in response to various operating conditions. As particular examples, control is transferred from the EMS to the ROCU in response to receiving an operator control command or crossing from a main line into a rail yard.

At 1312, the method includes determining if the rail vehicle is under manual ROCU control. For example, the operator manually provides input to an operator interface of the ROCU to control operation of the rail vehicle. If it is determined that the rail vehicle is under manual ROCU control, the method moves to 1314. Otherwise, the method returns to other operations.

At 1314, the method includes determining if an operator control command has been received by the ROCU that commands control of the rail vehicle be transferred from the ROCU to the EMS. If it is determined that the operator control command has been received, the method moves to 1318. Otherwise, the method moves to 1316.

At 1316, the method includes determining if the rail vehicle has exited a rail yard. If the rail vehicle has exited the rail yard, the method moves to 1318. Otherwise, the method returns to other operations.

At 1318, the method includes transferring control of the rail vehicle from the ROCU to the EMS. In one example, the ROCU sends a command to the EMS to take control of the rail vehicle from the ROCU. Control of the rail vehicle is transferred from the ROCU to the EMS in response to various operating conditions. As particular examples, control is transferred from the ROCU to the EMS in response to receiving an operator control command or crossing from a rail yard onto a main line. It will be appreciated that automatically switching between ROCU and EMS control in response to crossing between a main line and a rail yard are merely examples. Moreover, control of the rail vehicle can be automatically switched between the ROCU and the EMS in response to entering or exiting a suitable designated rail road track zone.

By switching control of a rail vehicle between manual control through the ROCU and automatic control through the EMS, a rail vehicle can be flexibly controlled from a remote location, such as when organizing rail vehicles in a rail yard, as wells as controlled with increased efficiency at track speeds when operating on a main line rail road track. The above method enables operation of a rail vehicle by a single-person crew under varying operating conditions, which allows for a re-allocation of labor resulting in increased cost savings.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A remote operator control system comprising:

a communication link to send and receive rail vehicle information;

an operator interface including a first transfer control input configured to receive operator input for transferring control of operation of a selected rail vehicle from manual control by the remote operator control system to automatic control by an energy management system; and a controller configured to send, through the communication link, a request to establish communication with a positive train control system on-board the selected rail vehicle based on an operating condition, send, through the communication link, a request to establish communication with the energy management system on-board the selected rail vehicle based on the operating condition, in response to receiving confirmation of communication with the positive train control system, receive positive train control information for the selected rail vehicle through the communication link, display the positive train control information for the selected rail vehicle on the operator interface, and send, through the communication link, control commands to the energy management system to take control of operation of the selected rail vehicle from the remote operator control system in response to receiving operator input through the first transfer control input.

2. The system of claim 1, wherein the operating condition includes the communication link being in a wireless communication range of the positive train control system.

3. The system of claim 1, wherein the remote operator control system is temporarily coupled to a cradle and the operating condition includes removal of the remote operator control system from the cradle.

4. The system of claim 1, wherein the positive train control information includes location information for the selected rail vehicle and travel restriction information that is based on the location information.

5. The system of claim 1, wherein the controller is configured to, in response to receiving confirmation of communication with the energy management system, receive rail vehicle state information for the selected rail vehicle through the communication link, and display the rail vehicle state information for the selected rail vehicle on the operator interface.

6. The system of claim 5, wherein the operator interface includes manual control inputs configured to receive operator input for manually adjusting operation of the selected rail vehicle; and the controller being configured to send, through the communication link, control commands to manually adjust operation of the rail vehicle in response to receiving operator input through the manual control inputs.

7. The system of claim 6, wherein the operator interface includes a second transfer control input configured to receive operator input for transferring control of operation of the selected rail vehicle from automatic control by the energy management system to manual control by the remote operator control system; and the controller being configured to send, through the communication link, control commands to the energy management system to relinquish control of operation of the selected rail vehicle to the remote operator control system in response to receiving operator input through the second transfer control input.

8. The system of claim 6, wherein the controller is configured to receive, through the communication link, control commands from the energy management system to take control of operation of the selected rail vehicle from the remote operator control system in response to a travel condition.

9. The system of claim 8, wherein the travel condition includes the selected rail vehicle crossing from a rail yard to a main line.

10. A method for remotely controlling a rail vehicle comprising:

transferring control of operation of a rail vehicle to a remote operator control system for manual control of the rail vehicle by a rail vehicle operator in response to a first operating condition including when the rail vehicle enters a predefined track zone; and transferring control of operation of the rail vehicle to an energy management system on-board the rail vehicle for automatic control of the rail vehicle by the energy management system in response to a second operating condition including when the rail vehicle exits the predefined track zone.

11. The method of claim 10, further comprising:

receiving rail vehicle state information from the energy management system at the remote operator control system; and displaying the rail vehicle state information on an operator interface of the remote operator control system.

12. The method of claim 10, further comprising:

receiving positive train control information from a positive train control system on-board the rail vehicle at the remote operator control system; and displaying the positive train control information on an operator interface of the remote operator control system.

13. The method of claim 10, wherein the first operating condition includes operator input commanding manual control of the rail vehicle by the remote operator control system, and the second operating condition includes operator input commanding automatic control of the rail vehicle by the energy management system.

14. The method of claim 10, wherein the predefined track zone is a rail yard.

15. A remote operator control system comprising:

a communication link to send and receive rail vehicle information;

an operator interface; and a controller configured to send, through the communication link, a request to establish communication with a positive train control system and an energy management system on-board a selected rail vehicle, in response to receiving confirmation of communication with the positive train control system, receive travel information for the selected rail vehicle through the communication link, in response to receiving confirmation of communication with the energy management system, receive rail vehicle state information for the selected rail vehicle through the communication link, and display the travel information and the rail vehicle state information for the selected rail vehicle on the operator interface, wherein the controller is configured to transfer control of operation of the selected rail vehicle from the remote operator control system to the energy management system.

16. The system of claim 15, wherein the controller is configured to transfer control of operation of the selected rail vehicle from the energy management system to the remote operator control system.

17. The system of claim 16, wherein the controller is configured to relinquish control of operation of the selected rail vehicle to the energy management system.

* * * * *